US008009182B2

(12) United States Patent
Shibahara

(10) Patent No.: US 8,009,182 B2
(45) Date of Patent: Aug. 30, 2011

(54) DISPLAY DEVICE WITH FUNCTION OF CONVERTING RESOLUTION

(75) Inventor: Hiroaki Shibahara, Osaka (JP)

(73) Assignee: Funai Electric Co., Ltd., Daito-shi, Osaka (JP)

( * ) Notice: Subject to any disclaimer, the term of this patent is extended or adjusted under 35 U.S.C. 154(b) by 842 days.

(21) Appl. No.: 12/005,201

(22) Filed: Dec. 26, 2007

(65) Prior Publication Data

US 2008/0158247 A1 Jul. 3, 2008

(30) Foreign Application Priority Data

Dec. 28, 2006 (JP) ..... 2006-355802

(51) Int. Cl.
*G09G 5/02* (2006.01)
*G09G 5/00* (2006.01)

(52) U.S. Cl. ..... 345/699; 345/3.4

(58) Field of Classification Search ..... 345/3.3, 345/3.4, 699
See application file for complete search history.

(56) References Cited

U.S. PATENT DOCUMENTS

| | | | | |
|---|---|---|---|---|
| 5,874,937 | A * | 2/1999 | Kesatoshi | 345/698 |
| 6,043,803 | A * | 3/2000 | Shimizu | 345/213 |
| 6,348,931 | B1 * | 2/2002 | Suga et al. | 345/3.3 |
| 6,654,026 | B2 * | 11/2003 | Lee | 345/3.4 |
| 6,664,970 | B1 * | 12/2003 | Matsushita | 345/600 |
| 6,670,964 | B1 * | 12/2003 | Ward et al. | 345/3.3 |
| 6,704,009 | B2 * | 3/2004 | Tachibana et al. | 345/3.3 |
| 6,768,498 | B1 * | 7/2004 | Kim | 345/698 |
| 6,816,171 | B2 * | 11/2004 | Kim | 345/3.3 |
| 7,317,451 | B2 * | 1/2008 | Kim | 345/213 |
| 2005/0035982 | A1 * | 2/2005 | Hong et al. | 345/698 |
| 2006/0284861 | A1 * | 12/2006 | Choi | 345/204 |

FOREIGN PATENT DOCUMENTS

| | | | |
|---|---|---|---|
| DE | 10108971 | A1 * | 9/2001 |
| JP | 11-015425 | | 1/1999 |
| JP | 2000-305529 | | 11/2000 |
| JP | 2006-072363 | | 3/2006 |

* cited by examiner

*Primary Examiner* — Chanh Nguyen
*Assistant Examiner* — Adam J Snyder
(74) *Attorney, Agent, or Firm* — Yokoi & Co., U.S.A., Inc.; Toshiyuki Yokoi

(57) ABSTRACT

There is provided a display device that enables to present an image on its screen at a desired resolution, in response to an operation by a user and on the basis of an image signal, even when the image signal is obtained from image data from which a resolution is not directly determinable. When image data from which the resolution is undeterminable is inputted, the display device presents thereon data input window that prompts the user to input desired values of the resolution and pixel clock at which the image is to be presented. The user then inputs his/her desired values of the resolution and pixel clock through the image-data input screen. Using the inputted values of the resolution and pixel clock, the display device presents the image on its screen based on the image data that is not normally supported by the display device.

6 Claims, 5 Drawing Sheets

FIG. 2

| RESOLUTION | H−sync (kHz) | V−sync (Hz) | PixelClock (MHz) |
|---|---|---|---|
| 640×480 | 31.5 | 60 | 25.175 |
| | 37.5 | 75 | 31.500 |
| 800×600 | 37.9 | 60 | 40.000 |
| | 46.9 | 75 | 49.500 |
| 1280×768 | 47.4 | 60 | 68.250 |
| | 60.3 | 75 | 102.250 |
| 1360×768 | 47.7 | 60 | 85.500 |

DISPLAY DEVICE WITH FUNCTION OF CONVERTING RESOLUTION

CROSS-REFERENCES TO RELATED APPLICATIONS

The present application is related to the Japanese Patent Application No. 2006-355802, filed Dec. 28, 2006, the entire disclosure of which is expressly incorporated by reference herein.

BACKGROUND OF THE INVENTION (1). Field of the Invention

The present invention relates to a display device that forms an image on the basis of image data received, and particularly to a display device that presents an image on the basis of a synchronizing signal of image data received.

(2). Description of the Related Art

There has been known a display device, such as television receiver, that is connectable to an image-data generating apparatus through a connector. Image data is outputted from the image-data generating apparatus to the display device, and an image based on the image data is presented on a screen of the display device. For instance, the image data generating apparatus may be a personal computer or a home video game machine.

FIG. 5 is a block diagram of the known display device. The display device 1 receives image data and displays an image based on the image data. The display device 1 includes a video-signal control circuit 2 and an image display unit 3. The video-signal control circuit 2 generates a RGB image signal on the basis of the image data received and the image display unit 3 presents an image on the basis of the image signal generated by the video-signal control circuit 2. The image data generated by the image-data generating apparatus is outputted through a cable 4 to the video-signal control circuit 2 so that the image is presented on the image display unit 3.

The video-signal control circuit 2 obtains a horizontal synchronizing signal and a vertical synchronizing signal from the image data received, and outputs the image signal to the image display unit 3 when the values of the obtained synchronizing signals correspond to values stored or registered in advance. The registered values of the horizontal and vertical synchronizing signals are set within a range that is determined depending on the capability or specification of the image display unit 3 and that of the video-signal control circuit 2.

Generally, resolution, pixel clock, and synchronizing signals are parameters defining presentation of image, and within a range there are an indefinitely large number of combinations of specific values of the resolution, pixel clock, and synchronizing signals. Accordingly, within a range there are an indefinitely large number of resolution values that the video-signal control circuit 2 support, in theory. However, the resolution at which an image is presented basically depends on the resolution of the image display unit 3 as operated in a normal display mode. Therefore, in the known display device the video-signal control circuit 2 implements an adjustment such as handling two pixels as one pixel, in order to resolve a conflict in resolution between the video-signal control circuit 2 and the image display unit 3. It is noted that the term "pixel clock" refers to an update frequency at which a color signal inputted to each pixel is updated when an image is displayed.

JP-A-2006-72363 teaches a method of reconciling a resolution conflict between a video-signal control unit and a display unit. That is, according to the method, when the resolution of image data received is higher than that of the display unit, the resolution of the image data is decreased so as to enable the display unit of the lower resolution to present an image based on the image data.

JP-A-11-15425 teaches a method of simplifying an operation required for a user to reconcile a resolution conflict between a video-signal control unit and a display unit. More specifically, when an image signal of a resolution that differs from the resolution of the display unit is to be presented, the user can make a resolution adjustment in a simplified manner, that is, the user directly can adjust the resolution of the display unit by switching the resolution at the side of the display unit.

JP-A-2000-305529 teaches a method according to which when there occurs a resolution conflict between a video-signal control unit and a display unit, a user is informed of this fact. That is, when the resolution of an image signal obtained is higher than the resolution of the display unit, a message indicating this fact is presented on the display unit.

However, according to the known techniques described above, when the resolution of the image data desired to be presented does not correspond to any of the registered values, the image can not be presented on the screen. Further, in order to widen the range of the values of the resolution of the image data capable of presentation to enable the display unit to present image data of any resolution value, it is required to predefine and store or register an indefinitely large number of combinations of values of the resolution of the video-signal control circuit, values of the synchronizing signals, and values of the pixel clock. For instance, where the above-described combinations, or correspondences among the resolution values and the values of the other parameters, are stored in a storage medium, the capacity of the storage medium should be sufficiently large to be capable of storing all the data of the combinations or correspondences.

BRIEF SUMMARY OF THE INVENTION

This invention discloses a display device that does not register or store a correspondence between a resolution value of image signal and a resolution value of a display unit, but can present an image based on an image signal of any resolution in response to an operation by a user even in a case where the resolution of received image data is not directly determinable.

One aspect of the present invention provides a display device that receives image data, converts, on the basis of a horizontal synchronizing signal and a vertical synchronizing signal of the image data, a resolution and a pixel clock of the image data to values registered in advance and supported by a monitor, and then output the image data to the monitor, the display device comprising: a synchronizing-signal detecting unit that detects a synchronizing signal of the image data; a data receiving unit which receives input of a value of a resolution and a value of a pixel clock of the image data; an image display unit that makes the monitor display the image by using, as the parameters, the synchronizing signal detected by the synchronizing-signal detecting unit and the values of the resolution and the pixel clock inputted to the data receiving unit.

According to the display device, the synchronizing-signal detecting unit detects the synchronizing signal of the image data, and the data receiving unit accepts input of values of the resolution and the pixel clock at which the received image data is to be presented. The image display unit makes output the image on the monitor, by using, as parameters defining presentation of the image, the values of the resolution and pixel clock inputted to the data receiving unit and the synchronizing signal of the image data detected by the synchronizing-signal detecting unit. Thus, even when the resolution of received image data is not directly determinable, an image can be presented on the monitor by input of values of the resolution and pixel clock through the data receiving unit. Hence, it is enabled to present an image on the monitor on the basis of an image signal of any resolution, without registering or storing correspondences between resolution values of image signal and resolution values of the display unit.

Preferably, the data receiving unit accepts the input of the values of the resolution and pixel clock when the following condition is satisfied. That is, when a correspondence between the value of a horizontal synchronizing signal and the value of a vertical synchronizing signal that are obtained as the synchronizing signal of the image data is not included in correspondences registered in advance.

According to this preferable form, the data receiving unit accepts input of values of the resolution and the pixel clock when the correspondence of the values of the synchronizing signal and horizontal synchronizing signal obtained as the synchronizing signal of the image data does not correspond to any of the correspondences between values of horizontal synchronizing signal and values of vertical synchronizing signal as registered or stored in advance. Hence, even image data, the correspondence between the values of whose horizontal and vertical synchronizing signals do not correspond to any of the registered correspondences, can be made compatible with the resolution of the monitor.

An optional aspect of the present invention provides the data receiving unit judges the correspondence between the value of a horizontal synchronizing signal and the value of a vertical synchronizing signal that are obtained with reference to a table registering correspondences between values of horizontal synchronizing signal and values of vertical synchronizing signal.

In this preferable form, the correspondences between horizontal and vertical synchronizing signals are registered in the form of a table, image data that is not supported by the monitor is promptly identified.

An optional aspect of the present invention provides The display device according to claim 4, the data receiving unit operates to present on the monitor a data input window, through which the values of the resolution and the pixel clock of the image data are inputted.

According to this preferable form, when values of the resolution and pixel clock are to be inputted, the data input window is presented on the monitor. Thus, a user can input values of the resolution and pixel clock while seeing the monitor, thereby enhancing the convenience for the user.

Another optional aspect of the present invention provides the display device is connectable with an analog RGB cable in order to receive the image data inputted there through, the analog RGB cable not having a limitation on resolution of image data to be transmitted thereby.

According to this preferable form, the image data received by the display device is inputted by means of the analog RGB cable. Thus, image data of any resolution can be outputted to the display device, and the display device is made to support any resolution. For instance, the analog RGB cable may be of D-sub 15-pin (Subminiature-D).

Another aspect of the invention provides a display device receives an image data from an image-data generating apparatus, convert, on the basis of a horizontal synchronizing signal and a vertical synchronizing signal of the received image data, a resolution and a pixel clock of the image data to values that are registered in advance and supported by a monitor, and then output the image data to the monitor, the display device comprising: a input inter face that is connectable through an analog Red Green Blue (RGB) cable to the image-data generating apparatus; a video-signal control circuit that converts the resolution and the pixel clock of the image data; a table registering correspondences between values of the horizontal synchronizing signal and values of the vertical synchronizing signal, and values of the resolution and values of the pixel clock of the image data that respectively correspond to the respective correspondences; and a control unit that (i) detects the horizontal and vertical synchronizing signals of the image data, (ii) operates to present a data input window on a screen when a correspondence between the detected horizontal and vertical synchronizing signals is not registered in the table, a value of the resolution and a value of the pixel clock at which the image data is to be presented being inputted through the data input window, and (iii) makes the video-signal control circuit convert the resolution and the pixel clock of the image data to the values inputted through the data input window, and output the image data to the monitor at the converted resolution and pixel clock.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character(s) present corresponding parts throughout:

FIG. 2 shows a table stored in a ROM of the display device.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

(1) Embodiment (1-1) Structure of the Display Device (1-2) Way of Presenting an Image when a Resolution Value at Which the Image is to be Presented is Not Directly Determinable.

(2) Gist of the Embodiment (1) Embodiment (1-1) Structure of the Display Device

By referring to FIGS. 1 to 4, there will be described the display device 10 according to the embodiment. The display device 10 has a screen and presents an image on the screen on the basis of image data that the display device has received. The display device 10 is connectable to image-data generating apparatus 100 so as to receive image data that the image-data generating apparatus 100 has generated. The term "image-data generating apparatus" refers to an apparatus that generates image data on the basis of a signal it receives or data stored in a storage medium, for instance. More specifically, the image-data generating apparatus 100 may be a personal computer or a home video game machine, for instance.

Figure 1:
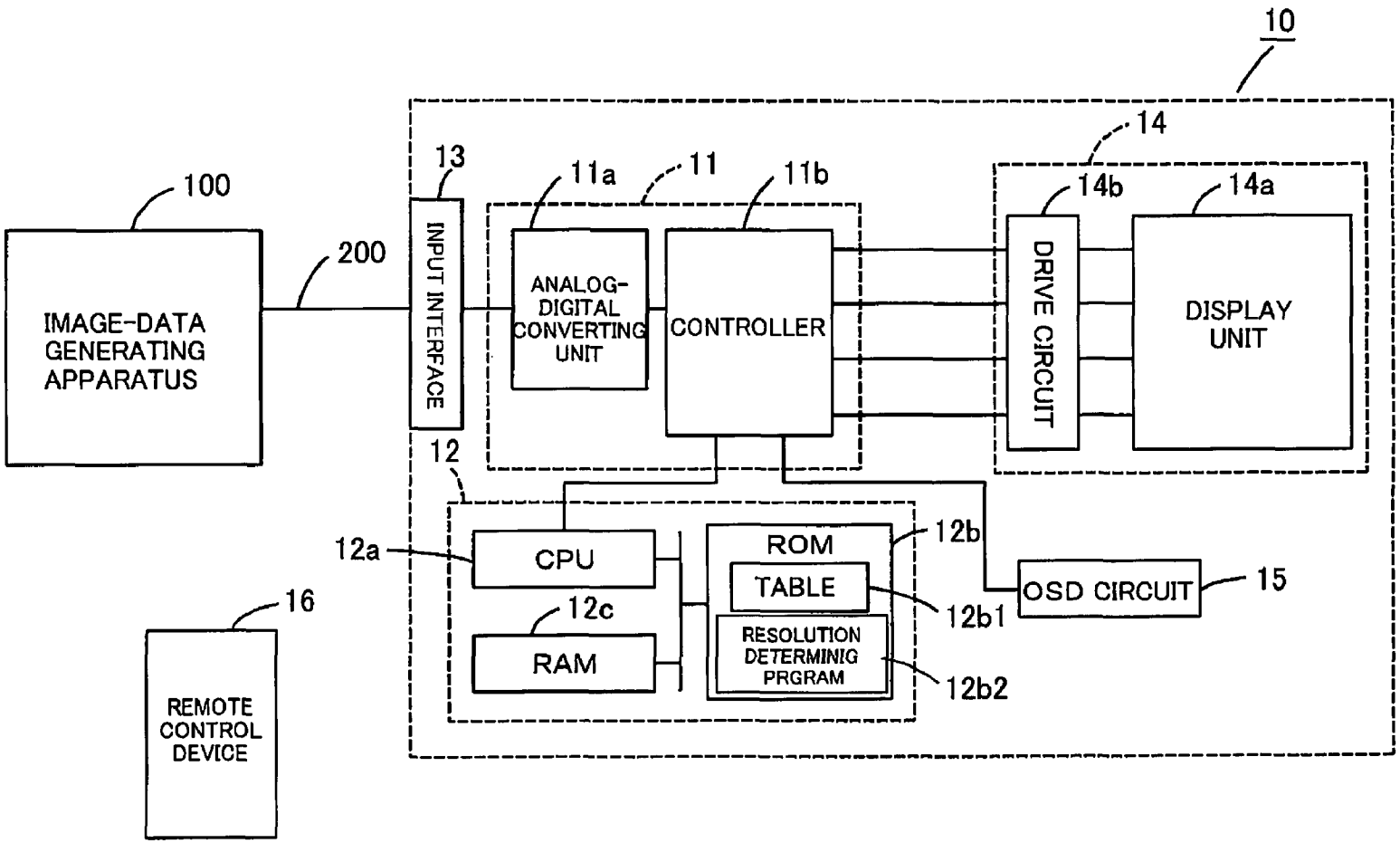
FIG. 1 is a block-diagram of a display device according to one embodiment of the invention.

FIG. 1 is a block diagram of the display device 10. The display device 10 receives image data from the image-data generating apparatus 100 via an input interface 13, and converts the image data into a digital image signal by means of a video-signal control circuit 11, under control by a control unit 12. The video-signal control circuit 11 processes the image signal in a predetermined manner. Then, the video-signal control circuit 11 outputs the image signal to a monitor 14, which presents an image on the basis of the image signal. At this time, it is possible that an OSD circuit 15 operates to present a predetermined image other than the image based on the image signal, in superposition on the image that is based on the image signal.

The display device 10 is connected with the image-data generating apparatus 100 through an analog RGB cable 200. The image-data generating apparatus 100 outputs RGB color signals and synchronizing signals to the display device 10 via the analog RGB cable 200. Although the display device 10 has the monitor 14 providing the screen, the structure of the display device 10 is not limited thereto and may not have the monitor 14.

The control unit 12 controls operation of the display device 10 through predetermined operations or arithmetic processing's. The control unit 12 includes a central processing unit (CPU) 12*a*, a ROM 12*b* as a non-volatile memory storing a program 12*b*2 and a table 12*b*1 that are used when a predetermined processing (described later) is implemented by the CPU 12*a*, and a RAM 12*c* including an area used when the program is executed by the CPU 12*a* and an area storing a result of the processing implemented during the execution of the program. More specifically, the table 12*b*1 stored in the ROM12*b* defines a relationship or a correspondence of values of resolution supported by the monitor 14 with values of the synchronizing signals and pixel clock. The program 12*b*2 is a resolution determining program according to which the CUP 12*a* implements the predetermined processing in a case where the resolution of image data received is not directly determinable.

The video-signal control circuit 11 processes the image data received from the image-data generating apparatus 100, so as to make the image data compatible with the display specification of the monitor 14. Further, based on an instruction from the control unit 12, the video-signal control circuit 11 processes in a predetermined manner the color signals as have been adjusted. More specifically, the video-signal control circuit 11 detects the values of the synchronizing signals from the image data inputted through the input interface 13, and implements a processing to present the image on the screen by using values of the resolution and the pixel clock that correspond to the detected values of the synchronizing signals.

FIG. 2 shows the table 12*b*1 stored in the ROM 12*b*. The table 12*b*1 stores a correspondence relationship among resolution of image data effective or supported by the video-signal control circuit 11, the horizontal synchronizing signal (H-sync) and the vertical synchronizing signal (V-sync), and the pixel clock. That is, the table 12*b*1 registers a plurality of correspondences each of which defines that one or two values of the horizontal synchronizing signal, one or two values of the vertical synchronizing signal, a value of the resolution supported by the video-signal control circuit 11, and one or two values of the pixel clock, are correspondent to one another. Each row of the table 12*b*1 defines one of the correspondences. When the horizontal and vertical synchronizing signals of the image data received are respectively 31.5 (kHz) and 60 (Hz), the CPU 12*a* determines that the resolution of the image data received is 640×480 and that the value of the pixel clock is 25.175 (MHz), in accordance with the table 12*b*1. Hence, the CPU 12*a* instructs the video-signal control circuit 11 to present the image on the monitor 14 at a resolution of 640×480.

The image data inputted to the video-signal control circuit 11 is converted into a digital image signal by an analog-digital converting unit 11*a*. The image signal is then inputted into a controller 11*b* to be subjected to a scaling processing for making the image signal supportable by the monitor 14, in other words, corresponding to one of the registered correspondences among values of the synchronizing signals, resolution, and pixel clock, that are within a displayable range of the monitor 14 as defined in the display specification thereof. In the above-described case where the horizontal and vertical synchronizing signals, as one form of a synchronizing signal, are 31.5 (kHz) and 60 (Hz), respectively, the controller 11*b* implements the scaling processing such that the resolution of the image signal becomes 640×480 and the pixel clock 25.175 (MHz).

The analog RGB cable 200 is for inputting data from the image-data generating apparatus 100 to the video-signal control circuit 11. In the present embodiment, the analog RGB cable is one that does not have a limitation on the resolution of image data to be transmitted thereby. Thus, it is made possible to input image data of resolution of a significantly wide range, through the input interface 13. For instance, the analog RGB cable 200 may be of D-sub 15-pin.

The monitor 14 presents the image on its screen on the basis of the image signal outputted from the video-signal control circuit 11. The monitor 14 has a display unit 14*a* for presenting an image, and a drive circuit 14*b* for applying a voltage to each pixel of the display unit 14*a*. The drive circuit 14*b* generates from the inputted image signal a drive signal for driving each pixel of the monitor 14. Thereafter, the drive circuit 14*b* applies the driving signal generated to each pixel of the display unit 14*a* to change the light transmittance at each pixel, thereby displaying the image.

(1-2) Way of Presenting an Image when a Resolution Value at Which the Image is to be Presented is Not Directly Determinable The display device 10 presents the image on the monitor 14 based on the image data received. The display device 10 can present the image on the monitor 14 by using the following method, in the case where the resolution of the image data received is not directly determinable. One of the causes of the resolution of the image data being not directly determinable is that the values of the synchronizing signals of the image data that are stored in the ROM 12*b* as being presentable by the monitor 14, and the values of the synchronizing signals of the image data actually received, do not coincide. Hence, the display device 10 is constructed to be capable of presenting an image on the screen when the user desires to do so, even where the values of the synchronizing signals of the image data received do not fall within the range supported by the monitor 14.

Figure 3:
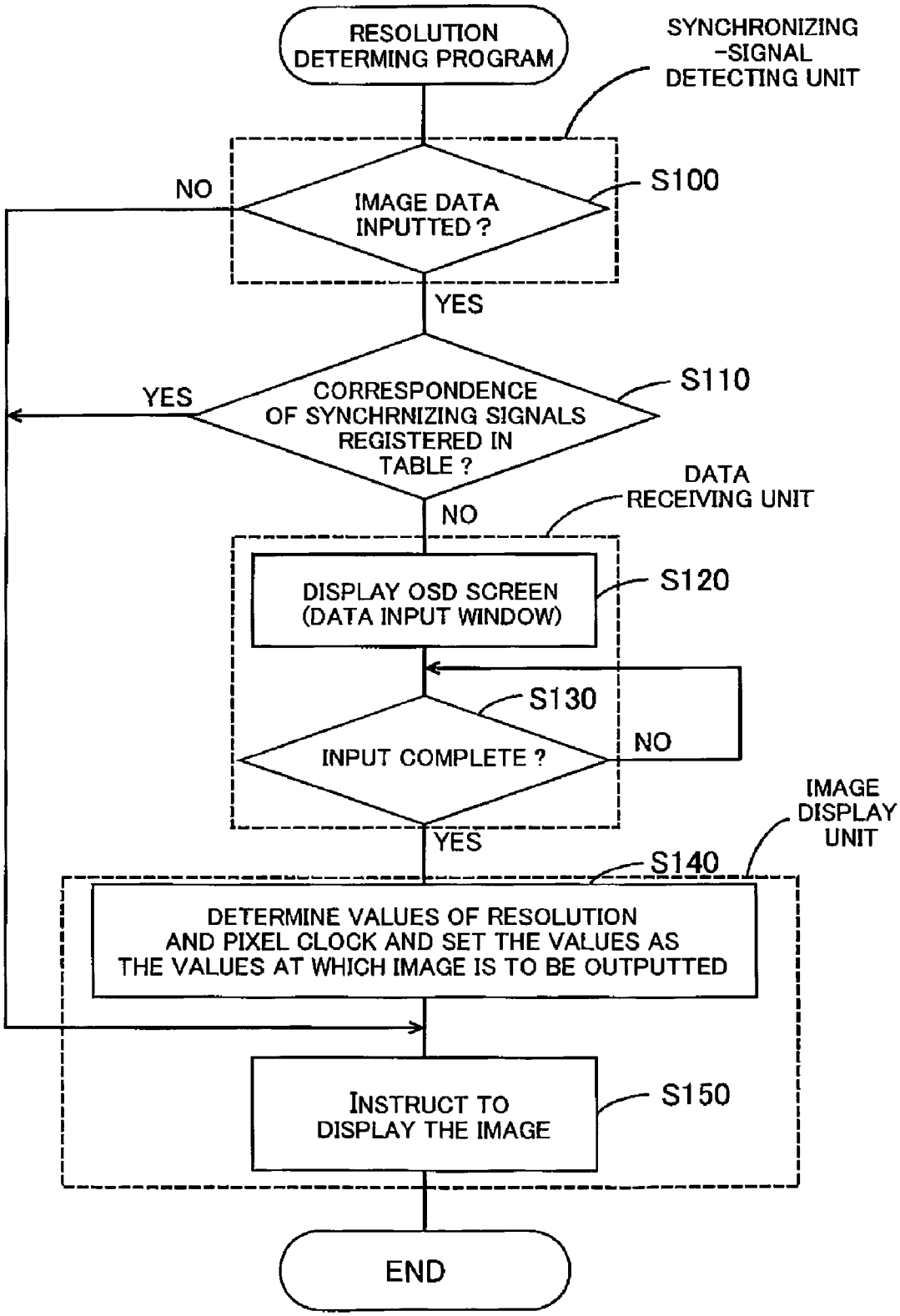
FIG. 3 is a flowchart of a processing according to which a CPU of the display device executes a resolution determining program stored in the ROM.

FIG. 3 is a flowchart along which the resolution determining program 12*b*2 stored in the ROM 12*b* is executed by the CPU 12*a*. There will be described along the flowchart of FIG. 3 how an image is presented in the case of the image data from which the resolution is not directly determinable. In an initial step S100 of the processing flow, the video-signal control circuit 11 receives the image data and the CPU 12*a* detects synchronizing signals from the received image data. The processing flow then goes to step S110 in which the CPU 12*a* determines whether the detected values of the synchronizing signals correspond to any of the correspondences in the table stored in the ROM 12*b*. When the values of the detected synchronizing signals correspond to a correspondence in the table 12*b*1, the processing flow goes to step S150 in which the CPU 12*a* refers to the table 12*b*1 to obtain values of the resolution and the pixel clock that correspond to the correspondence or values of the detected synchronizing signals, and outputs an instruction to the video-signal control circuit 11 to adjust the image signal on the basis of the obtained values of the resolution and pixel clock.

On the other hand, when the values of the detected synchronizing signals do not correspond to any correspondence or values in the table 12*b*1, the processing flow goes to step S120 in which the CPU 12*a* outputs an instruction to the OSD circuit 15 to present a data input window, which prompts the user to input values of the resolution and the pixel clock of the received image data. When the data input window is presented on the screen, the user inputs values of the resolution and pixel clock by means of a remote-control unit 16 or otherwise.

Figure 4:
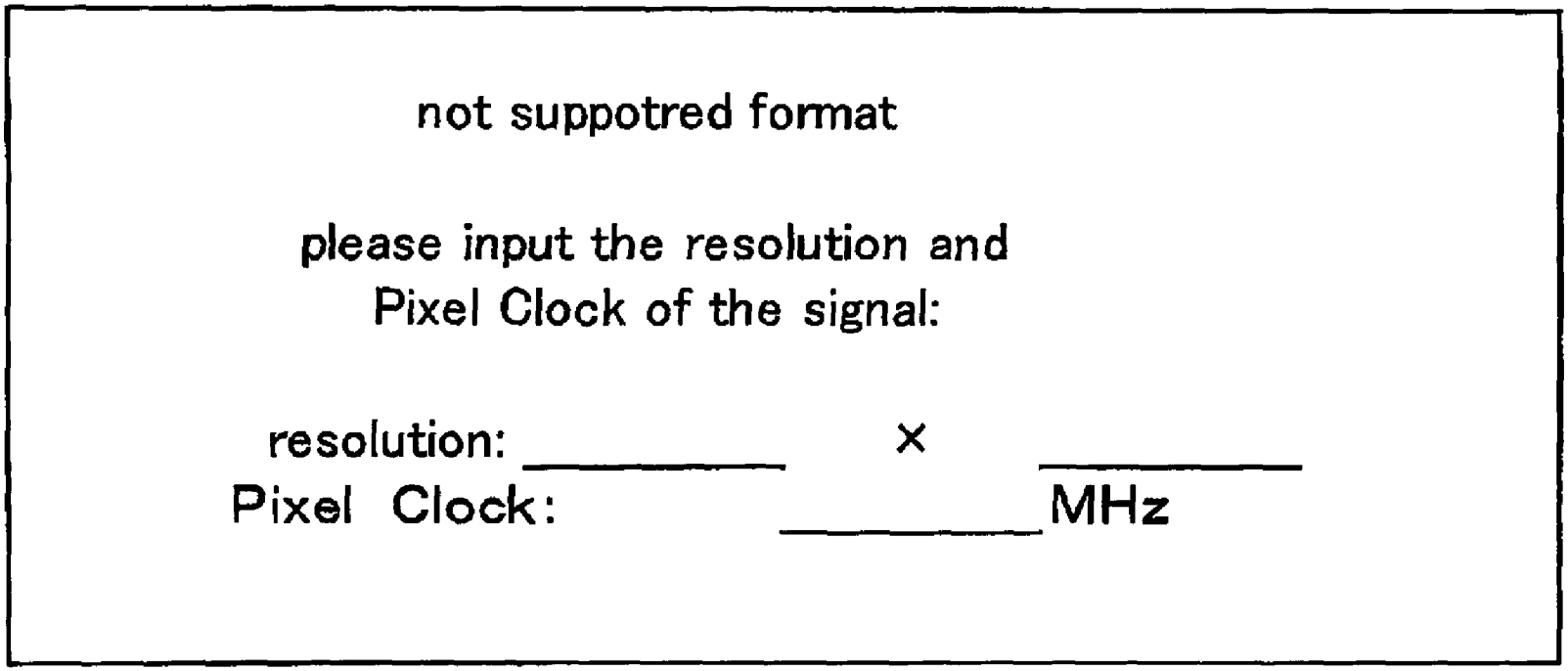
FIG. 4 is a view of a screen of the display device on which a data input window is presented.
Figure 5:
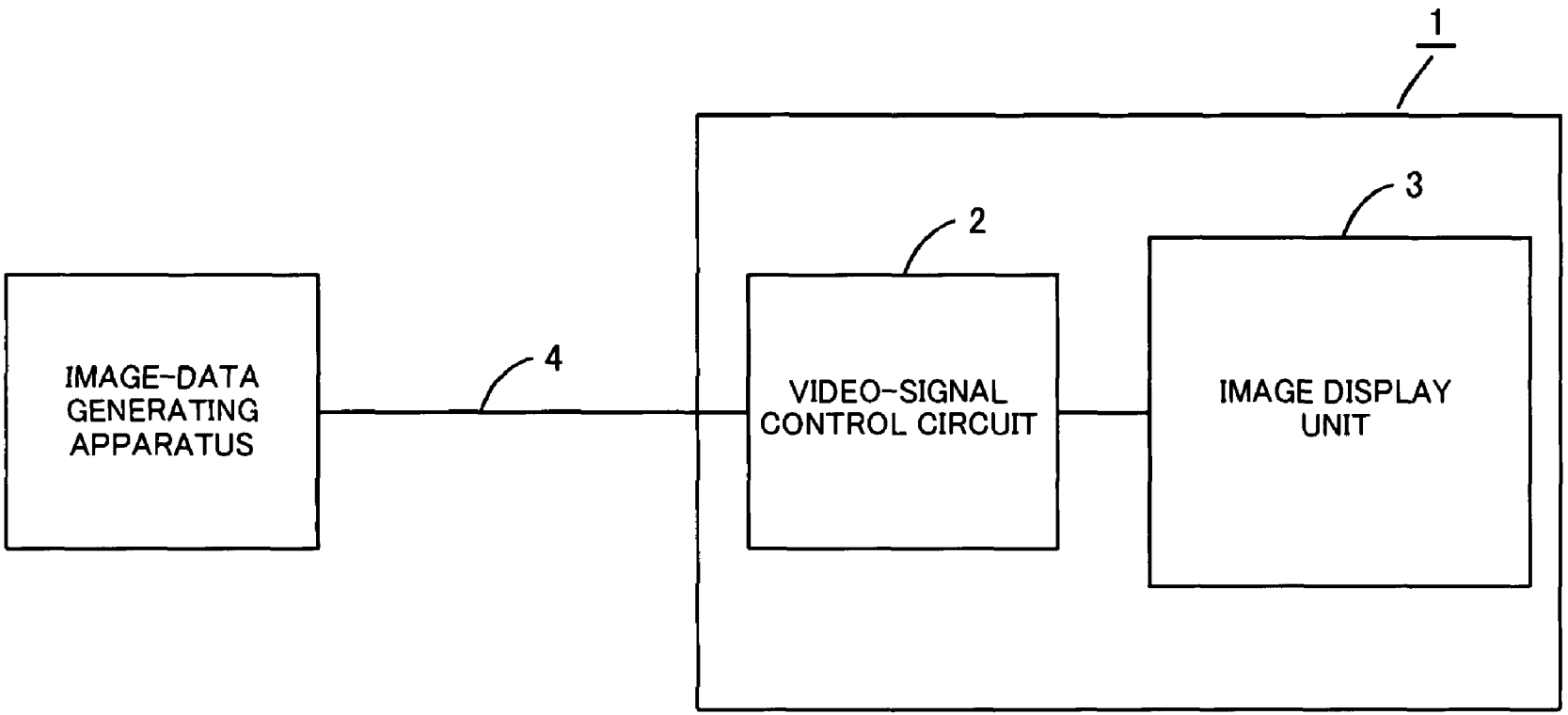
FIG.5 PRIOR ART
FIG. 5 is a block diagram of a known display device.

FIG. 4 shows an example of the data input window presented on the screen. In an upper unit of the data input window, there is presented a letter string "not supported format" meaning that the resolution of the received image data is not supported. In a middle unit of the screen, there are presented letter strings "resolution" and "Pixel Clock". While the data input window is presented on the screen, the user inputs values of the resolution and the pixel clock at which the received image data is to be presented, in blank spaces after the respectively corresponding letter strings. In this manner, the user can determine the values of the resolution and pixel clock of the received image data as he/she desires.

The processing flow then goes to step S130 in which it is determined whether the values of the resolution and pixel clock are inputted through the data input window on the screen. When an affirmative decision (YES) is obtained in step S130, the processing flow goes to step S140 in which the CPU 12*a* sets the values of the resolution and pixel clock of the image signal of the image to be outputted to the monitor 14, at the inputted values of the resolution and pixel clock. The processing flow then goes to step S150 in which the CPU 12*a* outputs an instruction to the video-signal control circuit 11 to generate an image signal on the basis of the set values of the resolution and pixel clock so that an image is presented based on the image signal. Upon receiving the instruction, the video-signal control circuit 11 generates the image signal on the basis of the set or determined values of the resolution, synchronizing signals, and pixel clock, which are the parameters necessary in presenting an image. The video-signal control circuit 11 then outputs the image signal to the monitor 14.

At this time, the video-signal control circuit 11 may modify the generated image signal so as to make the resolution of the image signal supportable by the monitor 14. Thus, an image based on the values of the resolution and pixel clock that are inputted by the user as he/she desires is presented on the screen of the monitor 14.

(2) Gist of the Embodiment

As has been described above, when image data from which the resolution is not directly determinable is inputted, the CPU 12*a* operates to present on the screen the data input window prompting the user to input desired values of the resolution and pixel clock. The user can present, on the screen, image data that is not normally supported, by inputting through the data input window unsupported values of the resolution and pixel clock. Since any values of the resolution and pixel clock are settable by the user, it is not necessary to register or store a correspondence between the resolution of image signal and that of the display unit. Hence, image signals of any resolution are presentable, without requiring a large storage capacity.

By step S100, CPU12*a* realizes the function of synchronizing-signal detecting unit. By step S120 and S130, CPU12*a*, and OSD circuit 15, realizes the function of data receiving unit. By step S140 and S150, CPU12*a* and monitor 14 realizes the image display unit.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

What is claimed is:

1. A display device receives an image data from an image-data generating apparatus generating image-data, convert, on the basis of a horizontal synchronizing signal and a vertical synchronizing signal of the received image data, a resolution and a pixel clock of the image data to values that are registered in advance and supported by a monitor, and then output the image data to the monitor, the display device comprising:

a input interface that is connectable through an analog Red Green Blue (RGB) cable to the image-data generating apparatus;

a video-signal control circuit that converts the resolution and the pixel clock of the image data, the video-signal control circuit comprises of an analog-digital converting unit which converts an analog image signal inputted through the input interface into a digital image signal and a controller that implements scaling processing to convert resolution of a digital image-data represented by the digital image signal to a resolution and a pixel clock which are supported by the monitor;

a table registering correspondences between values of the horizontal synchronizing signal and values of the vertical synchronizing signal, and values of the resolution and values of the pixel clock of the image data that respectively correspond to the respective correspondences; and a control unit that (i) detects the horizontal and vertical synchronizing signals of the image data, (ii) operates to present a data input window on a screen when a correspondence between the detected horizontal and vertical synchronizing signals is not registered in the table, and take a value of the resolution and a value of the pixel clock inputted through the data input window as a value of the resolution and a value of the pixel clock of the image data, and (iii) makes the video-signal control circuit convert the resolution and the pixel clock of the image data from the resolution and the pixel clock inputted through the data input window to the resolution supported by the monitor, and output the image data to the monitor at the converted resolution and pixel clock and; the analog-digital converting unit of the video-signal control circuit converts the analog image signal inputted through the input interface into the digital image signal according to the inputted resolution and the pixel clock into the digital image signal, then the controller of the video-signal control circuit implements scaling processing to convert the resolution of the digital image-data to the resolution supported by the monitor.

2. A display device that receives image data, converts, on the basis of a horizontal synchronizing signal and a vertical synchronizing signal of the image data, a resolution and a pixel clock of the image data to values registered in advance and supported by a monitor, and then output the image data to the monitor, the display device comprising:

a synchronizing-signal detecting unit that detects a synchronizing signal of the image data;

a data receiving unit that receives input of a value of a resolution and a value of a pixel clock of the image data, the data receiving unit presents a data input window on a screen when a correspondence between the detected horizontal and vertical synchronizing signals is not registered in advance, and take a value of the resolution and a value of the pixel clock inputted through the data input window as the value of the resolution and the value of the pixel clock of the image data;

a video-signal control circuit that converts the resolution and the pixel clock of the image data, the video-signal control circuit comprises of an analog-digital converting unit which converts an analog image signal inputted through the input interface into a digital image signal and a controller that implements scaling processing to convert resolution of a digital image-data represented by the digital image signal to a resolution which are supported by the monitor;

an image display unit that makes the monitor output the image by using, as the parameters, the synchronizing signal detected by the synchronizing-signal detecting unit and the values of the resolution and the pixel clock inputted to the data receiving unit, the image display unit makes the analog-digital converting unit of the video-signal control circuit convert the analog image signal inputted through the input interface into a digital image signal according to the inputted resolution and the pixel clock into a digital image signal, then the image display unit makes the controller of the video-signal control circuit implement scaling processing to convert the resolution of the digital image-data to the resolution supported by the monitor.

3. The display device according to claim 2, the data receiving unit receives the input of the values of the resolution and the pixel clock when a correspondence between the value of a horizontal synchronizing signal and the value of a vertical synchronizing signal that are obtained as the synchronizing signal of the image data is not included in correspondences registered in advance.

4. The display device according to claim 3, the data receiving unit judges the correspondence between the value of a horizontal synchronizing signal and the value of a vertical synchronizing signal that are obtained with reference to a table registering correspondences between values of horizontal synchronizing signal and values of vertical synchronizing signal.

5. The display device according to claim 4, the data receiving unit operates to present on the monitor a data input window, through which the values of the resolution and the pixel clock of the image data are inputted.

6. The display device according to claim 5, which is connectable with an analog RGB cable in order to receive the image data inputted there through, the analog RGB cable not having a limitation on resolution of image data to be transmitted thereby.

* * * * *